United States Patent [19]

Iwatschenko et al.

[11] Patent Number: 4,487,604

[45] Date of Patent: Dec. 11, 1984

[54] APPARATUS FOR DISPENSING NUTRITIONAL SUBSTANCES ENTERICALLY

[75] Inventors: Peter Iwatschenko, Neunkirchen; Fritz Giebler, Ostendorf, both of Fed. Rep. of Germany

[73] Assignee: Pfrimmer-Viggo GmbH & Co. KG, Erlangen, Fed. Rep. of Germany

[21] Appl. No.: 421,546

[22] Filed: Sep. 22, 1982

[30] Foreign Application Priority Data

Sep. 25, 1981 [DE] Fed. Rep. of Germany ..... 3138267

[51] Int. Cl.[3] ..... A61M 5/00; F04B 43/03

[52] U.S. Cl. ..... 604/153; 128/DIG. 12; 417/477

[58] Field of Search ..... 604/153, 151; 128/DIG. 12, DIG. 13; 417/475–477

[56] References Cited

U.S. PATENT DOCUMENTS

| | | | |
|---|---|---|---|
| 3,591,319 | 3/1969 | Shlisky | 417/477 |
| 3,990,444 | 11/1976 | Vial | 604/153 X |
| 4,179,249 | 12/1979 | Guttmann | 417/477 |
| 4,184,815 | 1/1980 | Casson et al. | 604/153 X |
| 4,256,437 | 3/1981 | Brown | 604/153 X |
| 4,278,085 | 7/1981 | Shim | 604/153 X |
| 4,397,639 | 8/1983 | Eshweiler | 604/153 |

*Primary Examiner*—Stephen C. Pellegrino

*Attorney, Agent, or Firm*—Jordan and Hamburg

[57] ABSTRACT

Apparatus for dispensing nutritional substances enterically according to physiological requirements includes an electrically driven pump which has electronic controls to operate the pump at a fixed rotational speed either continuously or at intervals and wherein the operating and non-operating periods of the pump can be pre-selected.

14 Claims, 10 Drawing Figures

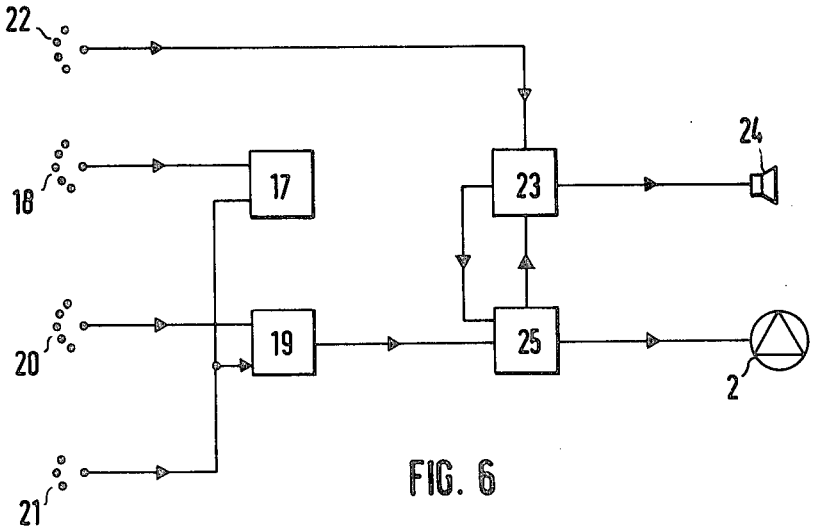
FIG. 6
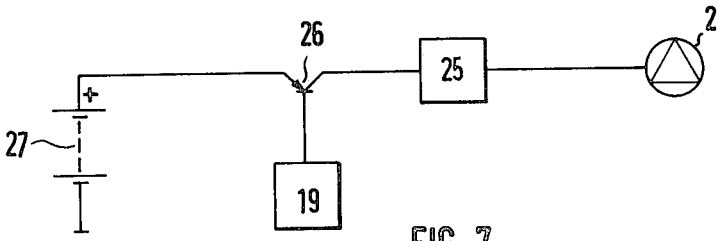
FIG. 7
FIG. 8
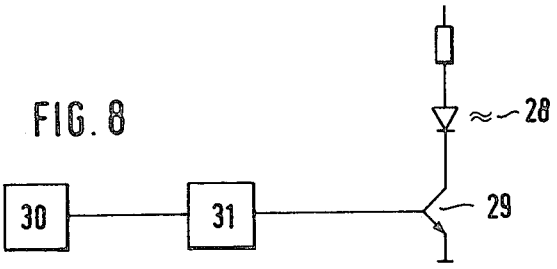

APPARATUS FOR DISPENSING NUTRITIONAL SUBSTANCES ENTERICALLY

BACKGROUND OF THE INVENTION

This invention relates to an apparatus for dispensing nutritional substances enterically. This is considered the physiologically most effective method to improve the nutrition of underfed patients and to insure a prognosis of favorable recovery.

In contrast to parenteral nutrition, which requires an invasive access to the patient, enteric nutrition uses the natural body cavity of the gastro-intestinal area to dispense nutrition. A probe is introduced into the body cavity and placed so that the nutritional fluid is dispensed in a specific area, for instance in the stomach area, the duodenum or jejuneum, and reabsorbed. The probe is connected to a storage container, containing the nutritional substance, mostly an industrially manufactured product. Heretofore, generally application was accomplished by means of a common hose clamp which allowed no exact dosage of the nutritional substance into the gastro-intentinal area. Common complications by this method of feeding are diarrhea and other gastro-intestinal side effects. These complications are primarily due to the unsatisfactory method for regulating the amount and speed of the nutrition. Based on these factors, the invention has as an object to provide an apparatus by means of which, and according to physiological demands, nutritional substance can be directed to the specific area of application. Depending on the way it is being used, this should enable a constant or quasi-constant output, for instance into the duodenum or jejuneum, or a bole application, for instance into the stomach. Furthermore, as a consequence of its medical importance, the invention has a high degree of reliability and is easy to operate. Finally, it is necessary that such an apparatus is constructed in such a way that it can easily and without operational disturbances be carried around by the patient.

This goal is achieved, according to the invention, by means of an electronically controlled, electrically powered pump, running at a fixed speed of rotation when turned on or operating, and which can be run continuously or at intervals with the operating and non-operating times being pre-selected by the electrical control system.

A pump which is run and controlled in such a manner maximizes the speed of rotation and the motor thus demonstrates a particularly favorable degree of efficiency which is important, especially when operating by battery. Since the operating and non-operating times can be regulated, the apparatus can be adjusted especially well to the various physiological demands and requirements, and, at the same time, it enables a very exact supply of nutrition.

The invention further provides for a roller pump. Such pumps in themselves are well known and are especially suited for use according to the invention, due to the fact that the supplied fluid is not brought into a sometimes hygienically problematic pump body, but rather is supplied through the pump inside a conduit or tube. It is of advantage that an intermittent or incremental motor is used to run the pump, enabling a particularly exact control Thus the intervals of operation of the motor can be coordinated with the dimensions of the pump plate or the roller pump in a suitable fashion. It is of further advantage that the power supply can be either from a battery or line current. Thus on the one hand, the mobility of the patient is guaranteed by the battery operation and, on the other hand, the batteries can be spared or even charged in the case of a stationary feeding situation.

It is within the framework of the invention that the electronic control equipment comprises independent, separately adjustable time unit oscillators with supplemented adjustable dividers. Through these time units, the interval lengths of the standing or non-operating and operating times are pre-selected. The design or operation chosen in the invention assures problem-free adjustability over a wide range. The independent adjustability of operating and non-operating times creates physiologically favorable conditions.

It is of particular advantage that the time units are connected to an adjustor or commutator to adjust the set-up as to length of time. In this way it is possible to achieve, by means of the prescribed, easily comprehensible scale, an exact adjustment for such varied orders of magnitude as seconds, on the one hand, and several hours, on the other hand.

Advantageously the motor may be connected to a meter, controlled by a signal given by the pump motor during the time of operation. By this meter, the total time of operation of the motor is covered, which corresponds proportionally to the supplied amount of nutritional substance.

Advantageous also is a report and alarm system attached to the meter. Because of this, the personnel operating the machine can read the already supplied amount of fluid, or set the predetermined amount in advance, so that either an automatic stop of the motor is effected after having reached the prescribed amount, or an accoustic and/or optical alarm signal is operated.

The invention also contains provisions for an arrangement to turn off the power electronics during the non-operating intervals. Through this the consumption of electricity is markedly reduced.

A transistor switch in the electrical current branch can be used to disconnect the apparatus.

It is advantageous that an indicating device is constructed in such a way that the indications ensue in an impulse-like manner, preferably at the magnitude of a couple of waves per second. Such impulse-like indicators are characterized by, on the one hand, lower consumption of current and, on the other hand, by a higher degree of attention, and are clearly noticeable even in bright rooms at a not too high degree of brightness. A luminous diode can be used as the indicating device.

It is advantageous that the plate, which carries the rollers of the roller pump and which is driven by an electric motor, is made of glass fiber reinforced polyamide. Thus a high degree of firmness and resistance against deformation is achieved by using a material which is also safe in every respect from a hygienic standpoint.

The plate is further provided with eight actuators over which are located slide sleeves which serve as rollers. These slide sleeves are preferably made out of polyacetale. It is, however, further possible that it will turn out to be of advantage that the slide sleeves may be arranged rotatary in a cage guide bearing. The thus achieved minimal friction of the rollers lowers the initial starting effort of the motor and thus its use of energy.

Under certain circumstances, it can further be of advantage that the rotating pump part is equipped with slide and contact sleeves in the fashion of planetary gearing. It is of advantage that between the sleeves of the roller pump and the nutrition transporting tube is placed a flexible band with an upper surface of a very low friction coefficient. With this arrangement, the rotating sleeves do not directly contact the tube, damaging it, and at the same time there is also avoided a possible accelerator effect, through which the tube as a whole would be moved in the apparatus.

The invention provides that the sliding body, against which the conveyor tube is pressed by the slide sleeves is designed as a pivoted lever. Thus it is readily possible to insert or remove the conveyor tube from the apparatus at the beginning and the end of the feeding process.

It is advantageous that the sliding body is pushed into the pump arrangement by means of a lever connected to an eccentric. Thus the sliding body can be brought into the working position by a turning knob with exactly determined end positions.

It is in this connection an advantage, if in order to produce a defined initial pressure, a spring arrangement is used.

For practical use, it is finally of advantage if the arrangement suggested by the invention has a hanger which enables a problem-free placement at, for instance, the bed of the patient.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

BRIEF DESCRIPTION OF THE DRAWINGS

FIG. 6 is a schematic view of the electronic control system.

FIG. 7 is a schematic view of the disconnecting system.

FIG. 8 is a schematic view of the indicator arrangement.

DESCRIPTION OF THE PREFERRED EMBODIMENTS

Figure 1:
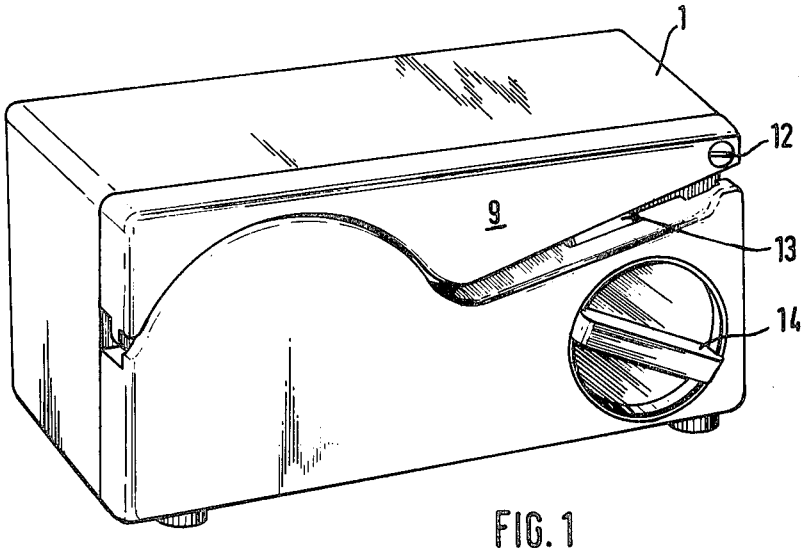
FIG. 1 is a perspective view of a device for dispensing nutrition enterically according to one embodiment of the invention.

One embodiment of an apparatus for dispensing nutrition enterically according to the invention is indicated at 1 in FIG. 1. An electric motor 2 drives a shaft 3 of which operates a pump plate 4. Pump plate 4 has several actuators 5 arranged at equal distances about its periphery. Each of these actuators has a slide sleeve made of polyacetale, while the pump plate 4 is made of polyamide. The rotating direction of electric motor 2 is indicated by arrow 7 in FIG. 5. The inner surface of a sliding body 8 extends generally parallel to the outer edge of pump plate 4 and in its entirety is in the form of a wing 9.

Figure 5:
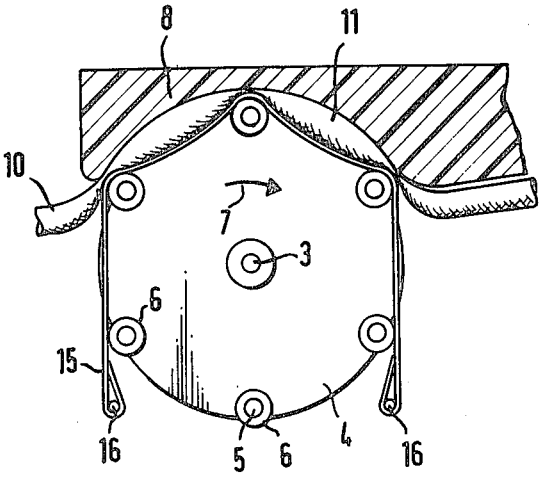
FIG. 5 is a longitudinal partial view in the area of the pump plate.
Figure 9:
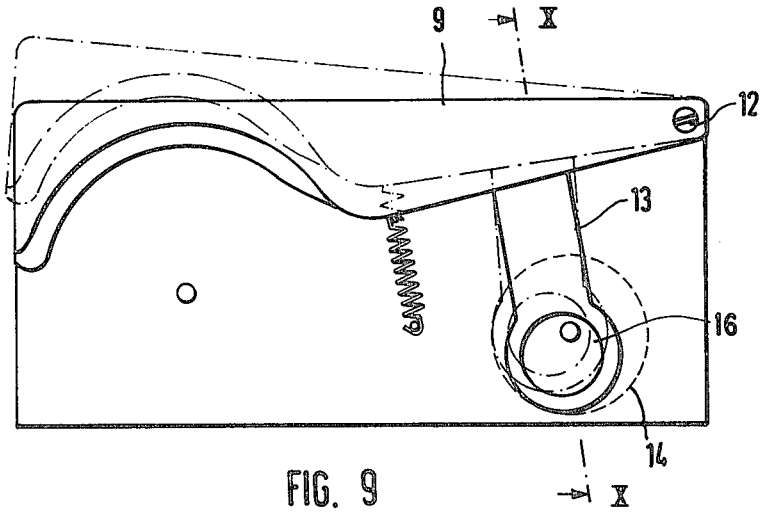
FIG. 9 is another front view of the apparatus.
Figure 10:
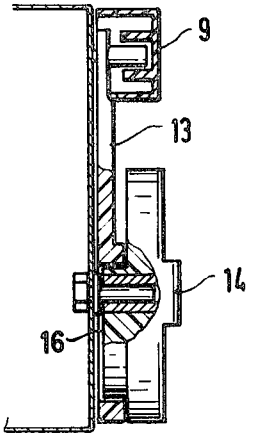
FIG. 10 is a sectional view taken along the line X—X in FIG. 9.

A nutritional substance-carrying tube 10, partially shown in FIG. 5, is pressed against the sliding body 8 by slide sleeves 6 on the pump plate 4 so that fluid-filled portions 11 of the tube 10 are created which are conveyed according to the rotating movement of the pump plate 4.

Figure 2:
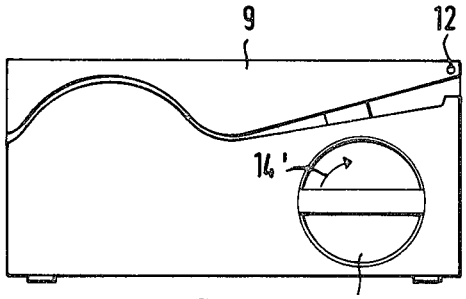
FIG. 2 is a front view of the apparatus shown in FIG. 1 in a closed position.
Figure 3:
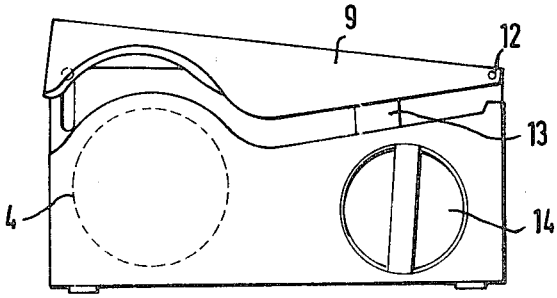
FIG. 3 is a front view of the apparatus in FIG. 1 in an open position.
Figure 4:
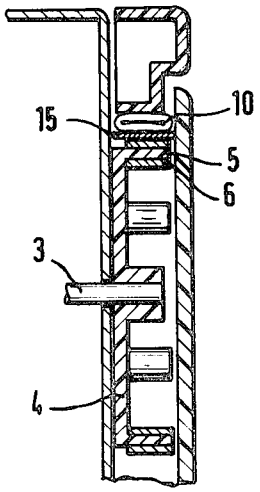
FIG. 4 is a cross sectional view in the area of the pump plate.

Sliding body 8 is attached to a pivot 12 on a support structure or part 1 in such a manner that the sliding body 8 can be pivoted. The pivoting action is effected by a lever 13 controlled by an eccentric 16 which is not described in detail. The operation of the eccentric 16 is effected by means of a knob 14 which is turned in the direction of arrow 14' shown in FIG. 2. Knob 14 has two defined positions, whereby one position corresponds to the position shown in FIG. 1 in which sliding body 8 is clamped downward onto tube 10, while the second position corresponds with the position shown in FIG. 3 in which body 8 is upwardly disposed. In this last position, tube 10 can be inserted without difficulty, and then by turning of knob 14 be fixed under sliding body 8. A spring arrangement, which is not described in detail, provides a defined starting pressure in this situation.

In order to avoid mechanical damage to tube 10 by slide sleeves 6 and to prevent an influential forwarding force on the tube 10, a flexible band 15 is provided to be disposed between the slide sleeves 6 and tube 10, the surface of which has an especially low friction coefficient. Band 15 is mounted on two permanent or fixed points 16 on part 1 and extends over the slide sleeves 6 of pump plate 4.

The control electronics of the arrangement, according to the invention, are designed in such a way that pump motor 2 is an intermittently operated motor and runs, when in operation, at a constant fixed speed of rotation. The rate of the output of the pump is controlled by correspondingly long disconnecting and connecting periods of motor 2. For this purpose, as shown in FIG. 6, a regulation control 18 is provided through which a time unit 17 can be controlled. Time unit 17 is designed as an oscillator with supplemented frequency divider and determines the length of the intervals between the working or operating period of the motor. A second corresponding time unit 19 with a regulation control 20 controls the length of the working periods of motor 2. Both time units 17 and 19 are additionally largely changeable by means of switch 21. Switch 21 is, for instance, designed in such a way that in one position, the length of the resting intervals is in the range of hours and the running time of the motor in the range of minutes, with desired supplied amounts around 100 ml, while in the second position, the operating and non-operating times are in the range of seconds. In the first position, the bole dose is controlled, while in the second position a quasi-continuous supply is achieved.

Meter 23, which can be actuated by means of a switch 22, is directed to operate according to the running time of pump motor 2. Having reached a predetermined value on the meter and thus having reached a predetermined total amount supplied, meter 23 disconnects the pump and releases an accoustical alarm as indicated at 24.

During non-operating periods of pump motor 2, the complete control power electronic unit 25 is disconnected from the supply source in order to lower the consumption of electricity. For this purpose, there is provided a transistor 26 which controls the power supply from the battery to the control power electronic 25 of pump motor 2. It is controlled by means of time unit 19 over the basic connection.

The operational condition of the apparatus is indicated by a luminous diode 28, which is turned on in an impulse-like manner by a transistor 29. Transistor 29 is directed by an oscillator 30 and a supplemented divider 31. The frequency of the impulse is chosen in such a way that a noticeable glimmer appears.

By way of example, the band 15 may be made of a coated web of polyester. The inner side, which is in contact with the actuators 5,6, is coated with polyuretan (low coeffizient of friction). The outer side, which is in contact with the tube 10, is coated with polyvinylchloride (high coeffizient of friction). Different colour of the coatings prevent errors when the band 15 is put in.

What is claimed is:

1. Apparatus for pumping and dispensing a nutrional substance enterically along a conduit comprising a support structure, an electrically driven pump on said support structure, said pump comrpising a plurality of actuators which are movable along a fixed path of travel to actuate said conduit to thereby pump said nutritional substance along said conduit, a pressing member, pivotal means pivotally mounting said pressing member on said support structure for pivotal movement between an operable position and a non-operable position, said pressing member having a generally circular section, when said pressing member is in said operable position said circular section being spaced from said path of travel of said rollers a distance less than the outer diameter of said conduit such that the part of the conduit between said circular section and said path of travel of said rollers is squeezed and collapsed to effect a pumping action along said conduit, when said pressing member is in said non-operable position said circular section being spaced from the path of travel of said rollers a distance at least as great as the outer diameter of said conduit such that said conduit can be inserted and removed from between said pressing member and said rollers, and actuating means mounted on said base support and connected to said pressing member such that operation of said operable means pivots said pressing member about said pivotal means between said operable and said non-operable position, said actuating means comprising a manually operable control member to pivot said pressing member between said operable and non-operable positions.

2. Apparatus according to claim 1, wherein said actuating means comprises a lever extending from said pressing member, and an eccentrically disposed member operably disposed between said lever and said pressing member such that rotation of the control member actuates said eccentrically disposed member and said lever to thereby pivot said pressing member.

3. Apparatus according to claim 2, wherein said pivotal means is disposed at one end portion of said pressing member and said circular section is disposed at the other end portion of said pressing member, said lever extending from said pressing member intermediate said pivotal means and said circular section.

4. Apparatus according to claim 1, wherein said support structure has a first portion generally underlying said pressing member and a second portion disposed generally laterally of said pressing member and generally laterally of said first portion, said pivotal means extending laterally from said second portion to overlie said first portion.

5. Apparatus according to claim 4, wherein said actuating means is disposed on said first portion of said support structure underlying said pressing member and said pivotal means.

6. Apparatus according to claim 1, wherein said pump is rotatable about a pump axis, said actuating means being disposed between said pump axis and the pivotal axis of said pivotal means.

7. Apparatus according to claim 1, wherein when said pressing member is in said operable position, said circular section of said pressing member is spaced from at least three of said actuators a distance less than the outer diameter of said conduit.

8. Apparatus according to claim 1 further comprising biasing means biasing said pressing member toward said operable position.

9. Apparatus according to claim 1 wherein a plurality of said actuators are mounted on a rotatable mounting plate, each of said actuators being radially spaced from the axis of rotation of said rotatable mounting plate, said actuators comprising roller elements on which sleeves are mounted.

10. Apparatus according to claim 9 wherein said mounting plate is made of glass fiber reinforced polyamide.

11. Apparatus according to claim 9 wherein said sleeves are rotatable on said actuators.

12. Apparatus according to claim 9 wherein said pump is constructed as a planetary gearing arrangement with said actuators being disposed around the axis of rotation of said plate.

13. Apparatus according to claim 1 further comprising a flexible band disposed between said actuators and said conduit, said band having a low coefficient of friction.

14. Apparatus for pumping and dispensing a nutrional substance enterically along a conduit comprising a support structure, an electrically driven pump on said support structure, said pump comprising a plurality of actuators which are movable along a fixed path of travel to actuate said conduit to thereby pump said nutritional substance along said conduit, a pressing member, pivotal means pivotally mounting said pressing member on said support structure for pivotal movement between an operable position and a non-operable position, said pressing member having a generally circular section, when said pressing member is in said operable position said circular section being spaced from said path of travel of said rollers a distance less than the outer diameter of said conduit such that the part of the conduit between said circular section and said path of travel of said rollers is squeezed and collapsed to effect a pumping action along said conduit, when said pressing member is in said non-operable position said circular section being spaced from the path of travel of said rollers a distance at least as great as the outer diameter of said conduit such that said conduit can be inserted and removed from between said pressing member and said rollers, said pivotal means being disposed at one end portion of said pressing member and said circular section being disposed at the other end portion of said pressing member, an eccentric element rotatably mounted on said support structure, a lever operatively connected between said eccentric element and said pressing member, said lever extending from said pressing member intermediate said pivotal means and said circular section, and a manually operable control member on said eccentric element such that rotation of said control member rotates said eccentric element to thereby pivot said pressing member between said operable and non-operable positions.

* * * * *